United States Patent [19]

Messmore

[11] 4,081,119

[45] Mar. 28, 1978

[54] CARRYING CASE

[76] Inventor: Robert L. Messmore, 1520 N. Pierson Rd., Peoria, Ill. 61604

[21] Appl. No.: 704,827

[22] Filed: Jul. 13, 1976

[51] Int. Cl.[2] ..... B65D 71/00

[52] U.S. Cl. ..... 224/46 R; 40/610; 40/152.1; 248/461

[58] Field of Search ..... 224/46 R; 220/22.3, 220/22.2, 22.1; 206/1.7, 44 R, 45.2, 45.23, 575, 577, 224, 449; 211/41, 184; 40/152.1, 155, 125 H; 24/201 A, 72.7, 222 BS; 292/DIG. 30; 248/460, 461; 190/1

[56] References Cited

U.S. PATENT DOCUMENTS

| | | | |
|---|---|---|---|
| 570,338 | 10/1896 | Reed | 211/41 C |
| 689,076 | 12/1901 | Grange | 206/45.23 |
| T927,008 | 10/1974 | Sherman et al. | 206/449 X |
| 1,930,347 | 10/1933 | Meyer et al. | 206/45.23 X |
| 1,947,745 | 2/1934 | Taylor | 190/1 X |
| 2,718,447 | 9/1955 | Wright | 206/1.7 X |
| 2,804,226 | 8/1957 | Freedman | 206/1.7 |
| 3,124,266 | 3/1964 | Morgan | 220/96 X |
| 3,297,118 | 1/1967 | Skyhawk et al. | 248/460 X |
| 3,318,354 | 5/1967 | Borisof | 24/201 A X |
| 3,938,772 | 2/1976 | Andrusiak | 40/155 X |

FOREIGN PATENT DOCUMENTS

| | | | |
|---|---|---|---|
| 1,179,099 | 12/1958 | France | 220/22.3 |
| 1,261,338 | 4/1961 | France | 206/45.2 |
| 202,534 | 9/1958 | Germany | 24/201 A |
| 288,634 | 9/1931 | Italy | 190/1 |
| 234,123 | 9/1944 | Switzerland | 206/45.2 |

*Primary Examiner*—Albert J. Makay
*Assistant Examiner*—Donald W. Underwood
*Attorney, Agent, or Firm*—Charles E. Lanchantin, Jr.

[57] ABSTRACT

A carrying case for transporting an article in an upright condition is described including a deep box having a front wall, a rear wall, a pair of side walls, a bottom, and defining an upwardly opening chamber therein. Advantageously, the case includes a laterally positionable holding apparatus which is secured to the box within the chamber for engagement with the opposite edges of the article and for holding it in spaced relation away from the front and rear walls. The case also includes a handle for carrying it and supporting it as a working surface, and a removable cover that serves as a tray.

6 Claims, 6 Drawing Figures

CARRYING CASE

BACKGROUND OF THE INVENTION

Artists have continually experienced problems in transporting wet oil paintings after partially completing them in the field or in the classroom. While improvised cardboard boxes have been used heretofore to carry and protect a single wet painting, these attempts have not been too successful. For example, a wet painting can be placed face up in a large flat box for transport in a horizontal position. However, two hands must be used to grasp the box and to guide it through narrow doorways, and this requires a considerable degree of dexterity. In other cases a deep box has been used by slidably depositing the painting through its narrow upper opening and against one of the inside walls after the box has been precariously inclined to receive it. This, of course, serves to retain the dry side of the painting against that inside wall. But here again, two hands must be used to transport it in the inclined position so the painting will not touch the opposite wall, and getting through a car door is very taxing. Furthermore, when these prior art boxes are carried outdoors in inclement weather gusts of wind frequently make the job of getting the painting to the car safely an exciting experience with but a marginal chance of success.

In addition, when more than one painting must be transported, and when they are of various sizes, the problems involved greatly multiply. Not only does the artist have to make several trips, but frequently he must carry the easel or display rack which he had been using and must find a place for it in the limited space remaining in the car.

SUMMARY AND OBJECTS OF THE INVENTION

This invention relates to a carrying case which is useful for protectingly transporting a relatively flat article in an upright condition away from the inside walls thereof, and also for displaying the article.

Accordingly, it is an object of the invention to provide a carrying case for protectingly holding and conveniently transporting a relatively flat article in an upright condition away from the walls thereof.

Another object of the invention is to provide a carrying case of the aforementioned type which is capable of holding more than one flat article in spaced apart relation.

Another object of the invention is to provide a case of the character described which includes provision for laterally adjustably engaging the edges of the article to permit adaptability thereof to various article widths.

Another object of the invention is to provide a case as described which is further capable of being converted to a display rack for the article.

Other objects and advantages of the present invention will become more readily apparent upon reference to the accompanying drawings and the following description.

DESCRIPTION OF THE PREFERRED EMBODIMENT

Figure 1:
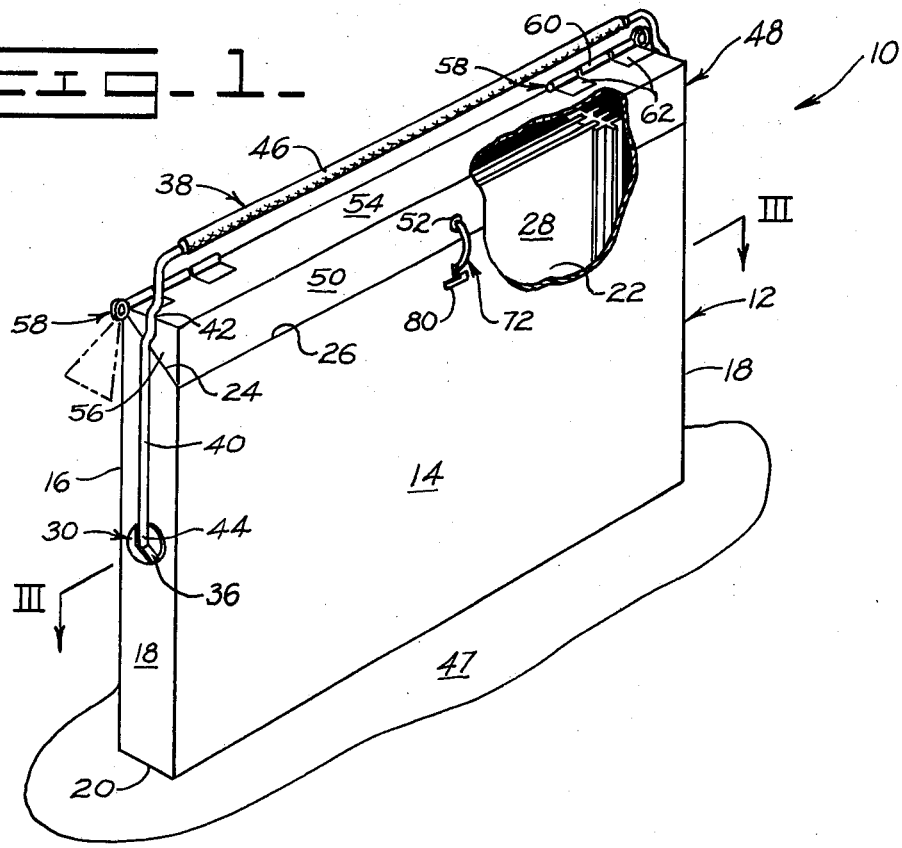
FIG. 1 is a front perspective view of the carrying case of the present invention in an upright or transporting condition with a portion broken open to illustrate a pair of flat articles which are protectively carried therein.
Figure 2:
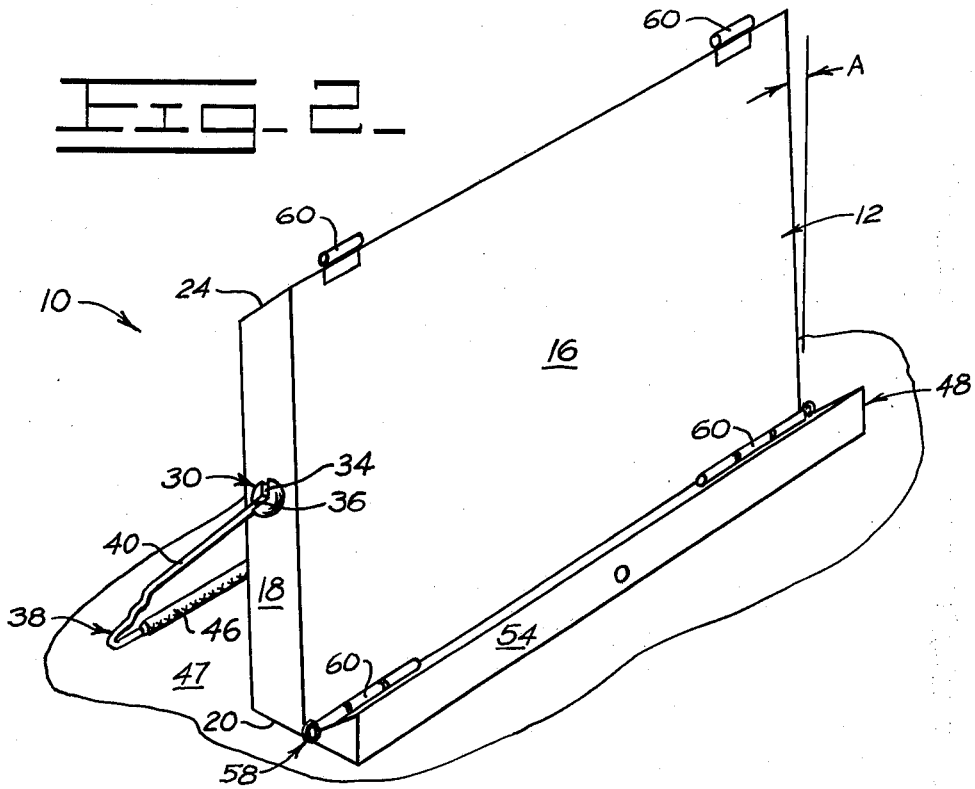
FIG. 2 is a rear perspective view of the carrying case of FIG. 1, only showing it propped up for work or display purposes and with the removable cover thereof converted to a tray.

As shown in FIGS. 1 and 2, the carrying case 10 of the present invention includes a relatively deep box 12 having a front wall 14, a rear wall 16, a pair of relatively narrow side walls 18, and a bottom or floor 20 to thereby define an upwardly opening chamber 22 therein. Each of the side walls has an inclined upper edge 24 which depends forwardly to terminate coincidingly with an upper edge 26 of the front wall. Thus, the front wall is of reduced overall height when compared with the rear wall to facilitate access to one or more relatively flat articles 28 positioned in an upright manner within the chamber of the box as will be described later below.

Figure 3:
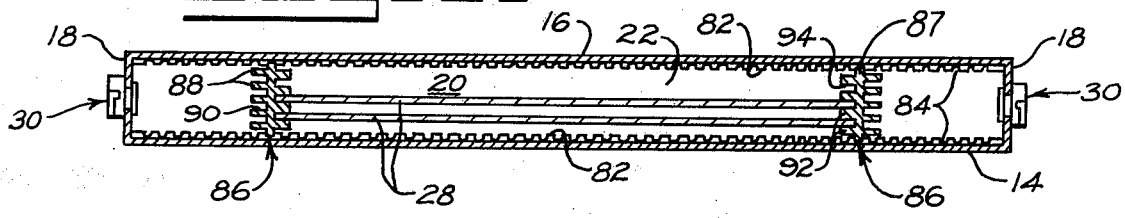
FIG. 3 is a horizontal sectional view of the carrying case of the present invention as taken along the line III—III in FIG. 1.
Figure 4:
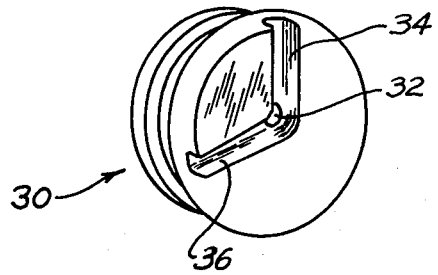
FIG. 4 is an enlarged side oblique perspective view of one of the support buttons or pivot joints shown in FIGS. 1, 2 and 3 to better illustrate details thereof.

A support button or pivot joint 30 is rigidly secured centrally to each of the side walls 18 of the box 12, and as shown best in FIGS. 3 and 4 each button includes an internal passage 32 centrally therein and an upright carrying groove 34 and an inclined support groove 36 extending radially therefrom in an outwardly facing manner.

Referring now to FIG. 1, an inverted, U-shaped metal handle 38 is pivotally secured to each of the buttons 30. Particularly, the handle includes a pair of depending legs 40 with each leg having a close corner fitting arcuate bend 42 at its upper portion and a laterally inwardly extending lower end 44 which is rotatably engaged within the button. Moreover, the legs are slightly converging so that they are spaced apart and inserted within the passages 32 of the buttons under a preload in an axially interlocking and positive manner. Furthermore, a roughly textured cylinder 46 of elastomeric or plastic material is mounted on the handle to permit the case 10 to be conveniently carried by one hand in an upright position.

In accordance with one aspect of the invention, the handle 38 may be pivoted downwardly and forwardly about the axis of the aligned buttons 30 to the position illustrated in FIG. 2 wherein the legs 40 will restably seat within the inclined grooves 36. Under this condition the textured cylinder 46 makes gripping frictional contact with a supporting surface 47 to brace the box 12 in an inclined position from a vertical plane as represented by the angle of inclination identified by the letter A.

In accordance with another feature of the invention, the carrying case 10 includes a removable cover 48 which may be converted to use as a tray as is apparent when making reference to FIGS. 1 and 2. The cover includes a front wall 50 with an opening 52 centrally therethrough, a top 54, a pair of triangularly shaped side walls 56, and a pair of laterally spaced hinges 58 which pivotally secure it to the rear wall 16 of the box 12.

Figure 5:
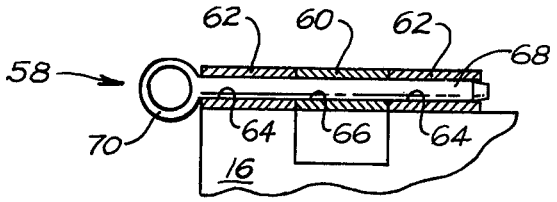
FIG. 5 is an enlarged fragmentary, diagrammatic and partially sectionalized view of a representative one of the hinges for the removable cover shown in FIG. 1.

Referring to FIG. 5, each of the hinges 58 includes a central bracket 60 which is appropriately attached to the rear wall 16 and a pair of cooperating end brackets 62 alignably disposed on the opposite sides thereof which are attached to the top 54 of the cover 48. A cylindrical passage 64 is formed in each of the end brackets, and a slightly oversized passage 66 is formed in the central bracket. This permits a hinge pin 68 having an easily grasped ring 70 at its outer end to be inserted into the laterally aligned passages, whereupon the pin is relatively loosely received in the center passage and more firmly received in the end passages. The cover may thus be freely pivoted from a closed position as shown in solid lines in FIG. 1 to an open position as shown broken lines to allow convenient access to the articles 28.

Figure 6:
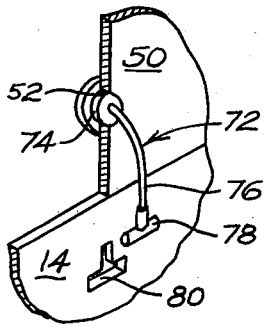
FIG. 6 is an enlarged fragmentary and partially sectionalized perspective view of the cover lock shown also in FIG. 1.

As best shown in FIG. 6, a relatively simple and economical lock 72 may be employed to positively secure the front wall 50 of the cover 48 downwardly to the front wall 14 of the box 12. A base portion 74 of the lock is fitted tightly in the opening 52, and a stretchable cable 76 having a T-shaped connector 78 at its outer end extends downwardly from the base portion. In order to positively hold down the cover and to protect the contents of the case 10 in inclement weather the connector is pulled downwardly and inserted in the cross bar of an inverted T-shaped slot 80 formed through the front wall 14, whereupon the elasticity of the cable will cause it to be entrapped upwardly in the slot.

Even with the lock 72 disengaged, however, it is to be noted when making reference to FIG. 1 that the bend 42 on each of the handle legs 40 is advantageously lightly frictionally engaged with each of the side walls 56 of the cover 48. Furthermore, each bend is constructed to extend laterally inwardly in an entrapping relation to the top 54 of the cover. Consequently, the handle itself is configured to maintain the cover in a closed position when transporting the carrying case 10, and the lock 72 may thus be considered optional.

In accordance with a major feature of the present invention, the box 12 can hold one or more relatively flat articles 28 away from the walls 14 and 16. As shown best in FIG. 3, this is accomplished by utilizing one or more pairs of guide strips 82 which are horizontally secured to the inside surfaces of the front and rear walls. These strips have a plurality of equally laterally spaced apart vertical notches 84 therein which are transversely alignably adapted to receive a pair of upright separating members or article holding elements 86. Specifically, a pair of opposite end bars 87 formed on the holding elements may be seated within selected pairs of the notches at any location across the carrying case 10. It is also apparent that each of these holding elements has a first plurality of vertically oriented ribs 88 forming narrow grooves 90 between them on one side thereof, and a second plurality of ribs 92 forming wide grooves 94 on the other side thereof. Thus, the holding elements are reversible to enable them to be better matched with articles of various thicknesses.

Operation

While the operation of the present invention is believed clearly apparent from the foregoing description, further amplification will subsequently be made in the following brief summary of such operation. In FIG. 1 the carrying case 10 is shown in an upright condition suitable for transport, and with the cover 48 fully protecting the articles 28 in the chamber 22. In this condition the case can easily be carried with one hand and guided through narrow doorways. Moreover, it may be lowered to the support surface 47 where it is capable of standing by itself vertically. During this time it is to be appreciated that the legs 40 of the handle 38 are disposed in the upright grooves 34 of the buttons 30 and therefore are maintained in a stable vertical position.

On the other hand, to permit the carrying case 10 to serve as a display rack or working surface such as a table-top easel, the handle 38 is moved rearwardly and downwardly pivotally about the buttons 30. This is accomplished by initially applying slight outward pressure on the handle legs 40 to unseat the bottom of the legs from the upright grooves 34 before rocking the handle forwardly. Upon reaching the predetermined angle of inclination shown in FIG. 2, the legs snap lightly into seated interlocking engagement with the inclined grooves 36, whereupon the cylinder 46 makes simultaneous contact with the support surface 47 as shown. Under these conditions the handle is advantageously braceably and interlockingly supported by the buttons so that the box 12 is disposed at a slight angle from the vertical as described earlier. This, of course, permits the rear wall 16 to be used as a display or work surface.

To open the cover 48 it is only necessary to uncouple the cover lock 72 from the slot 80 in the front wall 14 as mentioned heretofore in connection with FIGS. 1 and 6. This is accomplished by grasping the connector 78 and moving it downwardly and outwardly against the slight resistance of the stretchable cable 76. The cover can then be rocked rearwardly about the hinges 58 to allow access to the articles 28.

In accordance with one feature of the invention, however, the cover 48 can be easily removed by grasping the rings 70 and axially disengaging the pins 68 from the central brackets 60 of each of the hinges 58. This allows the cover to be lifted away from the case, and to be inverted, whereupon it may be realigned with another pair of central brackets 60 as shown in FIG. 2 which are secured at laterally spaced locations along the bottom 20 of the box 12 at the rear edge thereof. The hinge pins are then inserted axially in place at the bottom of the box to reinstall the cover in the new or second position where it may serve as a tray. Although not shown, it is to be understood that paint brushes or other working materials may be removably secured to the inside of the cover for convenience by resilient straps or the like.

Assuming that the articles 28 have been removed from the box 12, it is easy to appreciate that one or both of the holding elements 86 shown in FIG. 3 may be adjusted laterally to adapt the carrying case 10 to articles having a different width. For example, one of the holding elements may be lifted vertically out of one set of transversely aligned notches 84 and reinstalled vertically within another set of laterally displaced notches to accommodate one or more articles of a wider or narrower width. Furthermore, as stated above, the holding elements are reversible and cooperate in pairs to position either a few thick articles or a multiplicity of thinner articles away from the walls of the case.

Thus, it is evident that the carrying case of the present invention is so constructed and arranged as to protectingly transport one or more flat articles away from each other and the front and rear walls thereof. Furthermore, its handle is pivotable to support the case in an article displaying condition, and the cover is removably secured thereto so that it may be used as a tray. Still further, the carrying case includes laterally adjustable and reversible holding elements which are adapted to engage the opposite edges of an article having a variable thickness or width.

While the invention has been described and shown with particular reference to a preferred embodiment, it will be apparent that variations might be possible that would fall within the scope of the present invention, which is not intended to be limited except as defined in the following claims.

What is claimed is:

1. A carrying case comprising:

an upwardly opening box having a bottom, a first pair of facing walls connected rigidly to said bottom, a second pair of facing walls connected rigidly to said bottom, a top edge, and a bottom edge;

a removable member;

first means for releasably connecting said removable member to said box substantially at said top edge, said removable member being of a construction sufficient for serving as a cover to said box thereat, said first means including first and second hinge elements and a hinge pin, said first hinge element being connected to said removable member, said second hinge element being connected to said box substantially at said top edge, said hinge pin being of a construction sufficient for pivotally interconnecting said first and second hinge elements;

second means for releasably connecting said removable member to said box substantially at said bottom edge, said removable member being of a construction sufficient for serving as a tray thereat, said second means including a third hinge element connected to said box substantially at said bottom edge, said hinge pin being of a construction sufficient for pivotally interconnecting said first and third hinge elements.

2. The carrying case of claim 1 including a handle pivotally connected to said second pair of facing walls of said box and having an upright box carrying position, said handle being of a construction sufficient for frictional retaining engagement with said removable member when in said upright box carrying position and when said removable member serves as a cover.

3. A carrying case comprising:

an upwardly opening box having a bottom, a first pair of facing walls, a second pair of facing walls, a top edge, and a bottom edge;

a removable member;

first means for releasably connecting said removable member to said box substantially at said top edge, said removable member being of a construction sufficient for serving as a cover to said box thereat;

second means for releasably connecting said removable member to said box substantially at said bottom edge, said removable member being of a construction sufficient for serving as a tray thereat;

a handle pivotally connected to said box, said handle being of a construction sufficient for frictional retaining engagement with said removable member when said removable member serves as a cover; and means for selectively bracing said handle at a position sufficient for supporting said box at a preselected angle of inclination relative to a vertical plane.

4. A carrying case, for transporting an article in an upright condition, comprising:

an upwardly opening box including a front wall, a rear wall, a pair of side walls, a bottom, a top edge on said rear wall and a bottom edge on said rear wall;

holding means for carrying the article in spaced relation away from said front and rear walls;

a removable cover;

first means for releasably and pivotally connecting said removable cover to said top edge of said box, said first means including a first bracket connected to said rear wall;

second means for releasably and pivotally connecting said removable cover to said bottom edge of said box in an inverted position serving as a tray, said second means including a second bracket connected to said rear wall; and a third bracket connected to said removable cover, said brackets being of a construction sufficient for releasably receiving a hinge pin and being pivotally interconnected thereby.

5. The carrying case of claim 4 including a handle pivotally connected to said side walls of said box and means for selectively bracing said handle at a position sufficient for supporting said rear wall at a preselected angle of inclination relative to a vertical plane.

6. The carrying case of claim 5 wherein said handle is of a construction sufficient for retaining said cover in a closed position when said handle is in an upright box carrying position.

* * * * *